United States Patent [19]

Chizek

[11] Patent Number: 4,678,231

[45] Date of Patent: Jul. 7, 1987

[54] ADJUSTABLE CHAIR

[75] Inventor: Michael Chizek, Kenosha, Wis.

[73] Assignee: Contour Chair-Lounge Co., Inc., St. Louis, Mo.

[21] Appl. No.: 841,039

[22] Filed: Mar. 17, 1986

Related U.S. Application Data

[63] Continuation-in-part of Ser. No. 775,853, Sep. 13, 1985, abandoned.

[51] Int. Cl.[4] ..... A47C 1/02

[52] U.S. Cl. ..... 297/329; 297/330; 297/363; 74/89.15

[58] Field of Search ..... 297/329, 330, 463; 74/89.15, 441, 440; 403/149, 145; 248/632, 633

[56] References Cited

U.S. PATENT DOCUMENTS

| | | | |
|---|---|---|---|
| 661,208 | 11/1900 | Davis | 403/149 |
| 2,129,124 | 9/1938 | Geyer | 248/632 |
| 2,586,044 | 2/1952 | Horsky | 74/441 |
| 2,686,009 | 8/1954 | Crowe | 248/633 |
| 3,193,236 | 7/1965 | Thorn | 248/632 |
| 3,232,575 | 2/1966 | Ferro | 248/430 |
| 3,588,170 | 6/1971 | Knabusch | 297/330 |
| 3,640,140 | 2/1972 | Gulick et al. | 74/89.15 |
| 3,804,460 | 4/1974 | Leffler | 297/330 |
| 3,858,452 | 1/1975 | Gatland et al. | 74/89.15 |
| 4,046,241 | 9/1977 | Furtah | 74/89.15 |
| 4,101,168 | 7/1978 | Ferro | 297/329 |
| 4,173,372 | 11/1979 | Norris | 297/330 |
| 4,210,033 | 7/1980 | Erikson et al. | 74/441 |

*Primary Examiner*—Francis K. Zugel

*Attorney, Agent, or Firm*—William H. Eilberg

[57] ABSTRACT

An adjustable chair includes a seat portion having a convex undersurface and a base portion having a concave upper surface. Low profile roller assemblies are fixed in a spaced apart relation along the convex undersurface. Tracks are affixed along the concave upper surface of the base portion. The roller assemblies are adapted for rolling contact with the tracks. A power transmission assembly has a first end which is pivotably coupled to the seat portion and has a second end which pivotably connects to the base portion. The power transmission assembly moves the seat portion along an arcuate path defined by the base portion. A noise dampening preload spring is associated with the second end of the power transmission assembly.

13 Claims, 5 Drawing Figures

FIG. 3
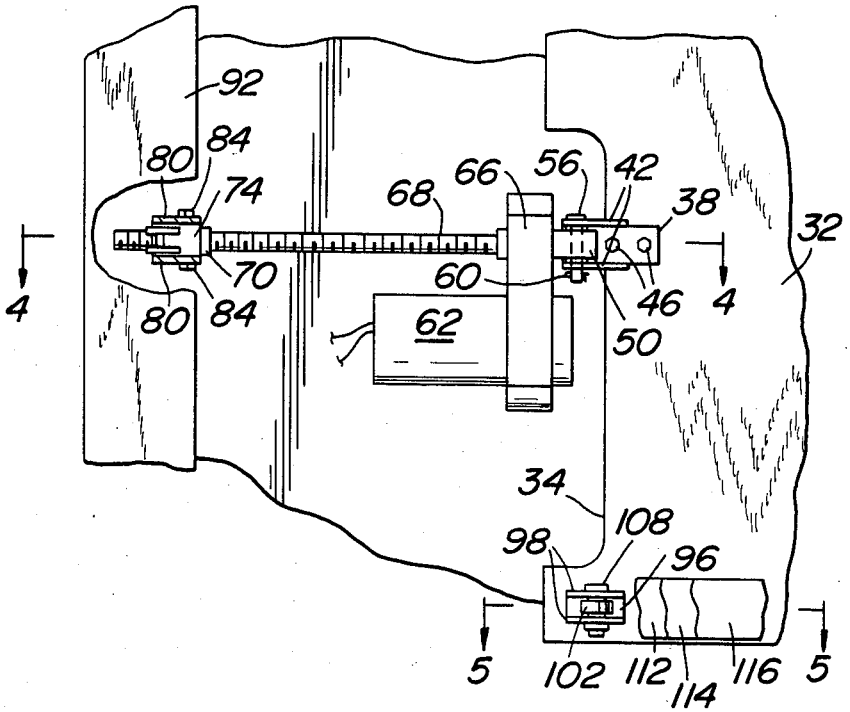
FIG. 4
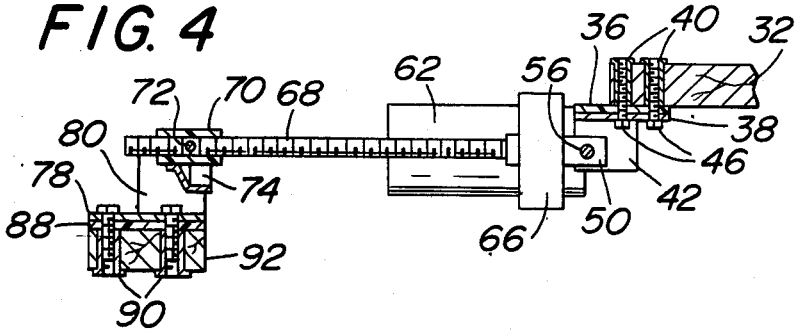
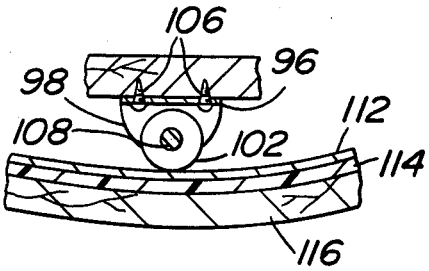
FIG. 5

ADJUSTABLE CHAIR

This is a continuation-in-part of co-pending application Ser. No. 775,853 filed on Sept. 13, 1985, now abandoned.

BACKGROUND OF THE INVENTION

The present invention is directed to an adjustable chair. Specifically, the present invention is directed to an adjustable chair comprising a noise dampening preloaded spring operably associated with a power transmission system and a plurality of low profile roller bearings disposed between a movable seat and a nonmoving base.

Heretofore, adjustable chairs have been known. The present invention embodies a number of improvements over previous adjustable chairs such as those adjustable chairs described in U.S. Pat. Nos. 3,232,575 and 4,101,168, incorporated herein by reference. These prior art adjustable chairs are noisy when operated in a no load mode, e.g., without anyone resting on the chair. These prior art chairs also use mechanical means to limit movement of the seat at the extreme ends of the arcuate path upon which the seat is movable. Furthermore, a gap spacing between the movable seat and nonmoving base is sufficiently wide so that portions of the human body could be pinched therebetween.

SUMMARY OF THE INVENTION

The present invention is directed to an adjustable chair. The adjustable chair has a seat portion having a convex undersurface. The seat portion includes laterally disposed convex side members joined together by a plurality of cross members. Roller means are affixed in a spaced apart relation along the convex side members. A base portion has a concave upper surface. The base portion includes laterally disposed concave side members joined together by a plurality of cross members. A plurality of legs are affixed to the concave side members. Track means are affixed in a spaced apart relationship along said concave side members. The roller means are adapted for rolling engagement along the track means. A power transmission means has a first end pivotably connected to the cross member of the seat portion. A second end of the power means is pivotably connected to a cross member of the base portion. The power means is adapted to move the seat portion along an arcuate path defined by the concave upper surface of the base portion. A noise dampening preloaded means is associated with the second end of the power means.

An object of the present invention is to provide an adjustable chair which may be operated quietly through the no load mode.

A further object of this invention is to provide low profile bearings which reduce the gap spacing between the seat portion and base portion thereby reducing the risk of pinching human parts therebetween.

Further objects of this invention will be apparent from the detailed description of the invention which follows.

DESCRIPTION OF THE DRAWINGS

For the purpose of illustrating the invention, there is shown in the drawings a form which is presently preferred; it being understood, however, that this invention is not limited to the precise arrangements and instrumentalities shown.

FIG. 3 a bottom view of the drive mechanism and track system, parts being broken away for clarity.

FIG. 4 is a sectional view taken along line 4—4 of FIG. 3.

FIG. 5 is a sectional view taken along line 5—5 of FIG. 3.

DETAILED DESCRIPTION OF THE INVENTION

Figure 1:
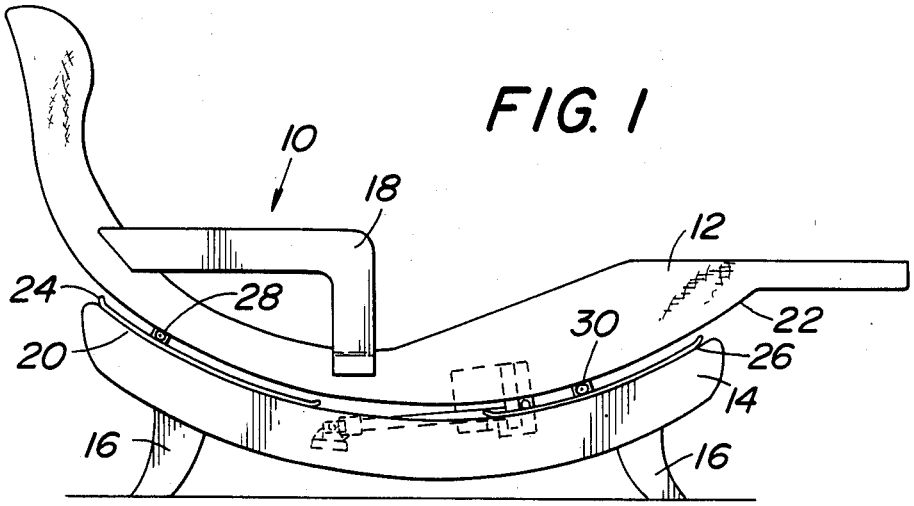
FIG. 1 is an elevational view of a chair made according to the present invention.

Referring to the drawings wherein like numerals indicate like elements there is shown in FIG. 1 an adjustable chair generally designated as 10. The adjustable chair 10 includes a seat portion 12 and a base portion 14. Seat portion 12 has a convex undersurface 22. Optionally, seat portion 12 may include an arm 18. The arm 18 has a mate (not shown) located on the opposite side of seat portion 12. Forward and rear low profile roller bearings 28 and 30 are affixed to the seat portion 12 in a spaced apart relationship which is further described below. These roller bearings have mates (not shown) located on the opposite side of seat portion 12. Base portion 14 includes an upper concave surface 20. Legs 16 are affixed to the base portion 14 so to support the chair 10 above the floor in a conventional manner. Forward and rear arcuate tracks 24 and 26 are located on the upper convex surface 22 of base portion 14. These arcuate tracks are described in greater detail below. Mates (not shown) to these tracks are located on the opposite side of base portion 14.

Seat portion 12 is adapted to be moved in the arcuate path defined by the upper concave surface 20 of the base portion 14. The forward and rear low profile bearings 28 and 30 are in rolling engagement with respective rear and forward arcuate tracks 24 and 26. The equipment for moving seat portion 12 along its arcuate path is described in greater detail below.

Seat portion 12 is constructed in a manner which is well understood by those skilled in the art. The seat portion 12 includes laterally disposed convex side members (not shown) joined together by a plurality of cross members (not shown). Such a construction is disclosed in U.S. Pat. No. 4,101,168 which is incorporated herein by reference.

Base portion 14 is also constructed in a manner which is known to those skilled in the art. Base portion 14 includes laterally disposed concave side members (not shown) joined together by a plurality of cross members (not shown). Such a construction is disclosed in U.S. Pat. No. 4,101,168 which is incorporated herein by reference.

The legs 16 are affixed to the underside of base portion 14. Alternatively, they may be affixed to either the lateral concave side members or to the cross members.

Figure 2:
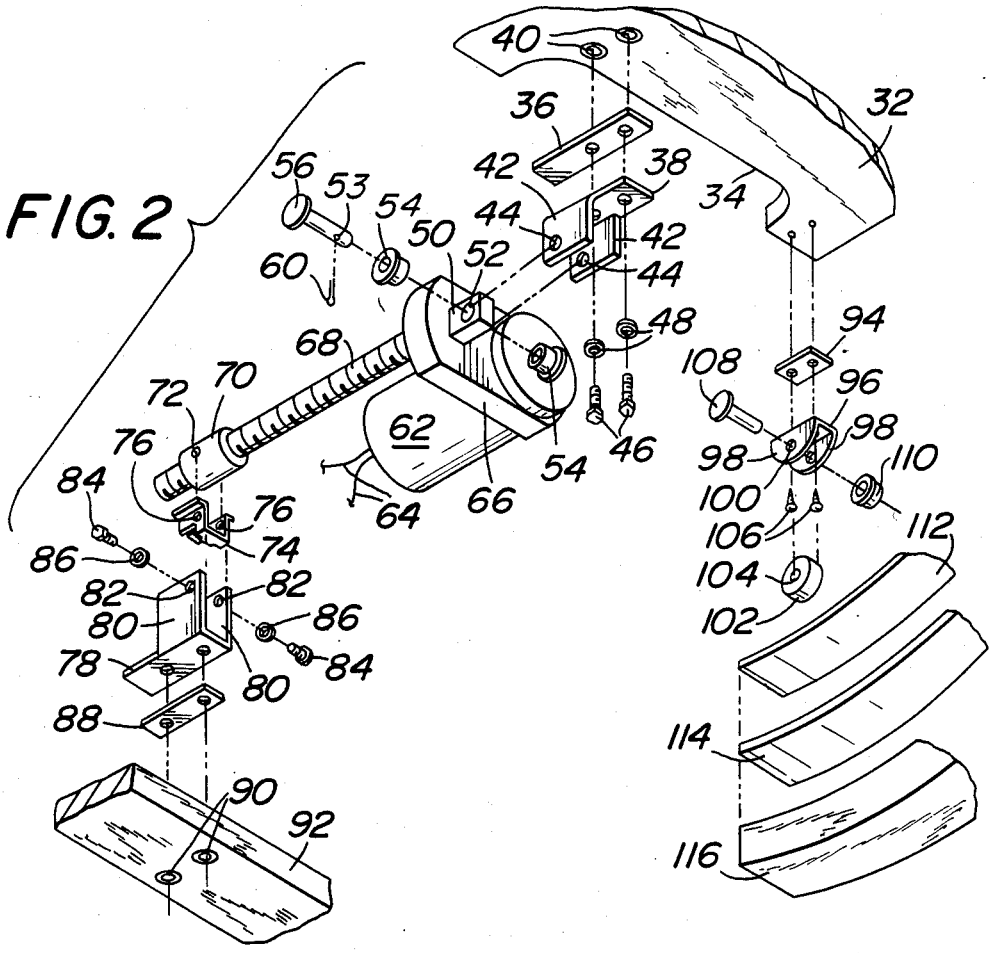
FIG. 2 is an enlarged exploded view of the drive mechanism and track system, parts being broken away for clarity.

Referring to FIG. 2, a seat cross member 32 has a recess 34. A pair of bracket mounting holes 40 are disposed through cross member 32. The pair of holes 40 are located adjacent an end of recess 34. The holes 40 are spaced apart perpendicular to the longitudinal axis of recess 34. An internally threaded anchor is disposed within each hole 40. An actuator bracket mounting pad 36 having a pair of holes disposed therethrough is placed in face contact with cross member 32. Mounting pad 36 is made of a plastic material and acts as a sound deadening and vibration reducing device. The holes through mounting pad 36 coincide with holes 40 of cross member 32. An actuator bracket 38 is located in face contact with mounting pad 36. Bracket 38 includes a pair of holes which coincide to the holes of pad 36 and to holes 40 of cross member 32. Bracket 38 is generally U-shaped in cross section and has a tongue located at the terminal end of the base of the bracket 38. Bracket arms 42 extends down at right angles from the base portion of bracket 38. Each bracket arm 42 includes a hole 44. The holes 44 of each bracket arm 42 are coaxial. Bracket 38 and pad 36 are secured to cross member 32 by a pair of bolts 46. Bolts 46 are placed through the holes of bracket 38, pad 36 and are threadedly engaged into the anchors located in holes 40 of cross member 32. Washers 48 are placed around bolts 46 prior to the insertion of those bolts into the holes of bracket 38.

An actuator mounting arm 50 has a hole 52 disposed therethrough. Mounting arm 50 is inserted between arms 42 of bracket 38. The hole 52 of mounting arm 50 is aligned with holes 44 of arms 42 of bracket 38. Mounting bushings 54 having coaxial bushing holes are inserted into holes 44 of arms 42 of bracket 38. A mounting pin 56 is then inserted through the bushing holes of bushings 54. The mounting pin 56 is then secured in place by a cotter pin 60. This assembly acts as a pivot which is explained later.

The mounting arm 50 is affixed to a transmission 66. The axis of hole 52 is parallel to transmission 66. Transmission 66 is coupled perpendicularly to a motor 62 and a threaded shaft 68. Transmission 66 is any transmission capable of translating rotary motion of motor 62 into rotary motion of shaft 68. Motor 62 is parallel to and spaced apart from shaft 68. Motor 62 is connected to an external source of electrical power through electrical lines 64. Motor 62 is any standard electrical motor capable of moving seat portion 12 with a load. Motor 62 is well-known in the art.

When motor 62 is actuated by an external command signal, such a signal can be supplied through a switch which is well known in the art. The rotary motion of motor 62 is communicated through transmission 66 to rotary motion of shaft 68. An acme nut 70 is threadingly engaged on shaft 68. Acme nut 70 travels along the longitudinal axis of shaft 68, The acme nut 70 is indirectly coupled to the base portion 14, as described below. Thus, as acme nut 70 travels seat portion 12 moves in its arcuate path. Acme nut 70 includes a pair of internally threaded holes diametrically opposed through the acme nut 70. A noise dampening preloaded spring 74 straddles acme nut 70. Spring 74 includes a pair of arms having coaxial holes 76 and outwardly extending flanges. The flanges engage the terminal ends of arms 80. The flanges prevent spring 74 from rotating about mounting bolts 84. Holes 76 are aligned with holes 72 of acme nut 70. Spring 74 also includes a tongue. The tongue of spring 74 is integral with the base of spring 74. The tongue is inclined toward the acme nut 70. The free end of the tongue is in engagement with the acme nut 70. See FIG. 4. Spring 74 eliminates noise when seat portion 12 moves through the no load mode.

A base cross member 92 has a pair of bracket mounting holes 90. Bracket mounting holes 90 are disposed through cross member 92 and are perpendicular to the longitudinal axis of cross member 92. An internally threaded anchor is secured within each of the holes 90. A bracket mounting pad 88 having a pair of holes therethrough is in face contact with cross member 92. The holes of pad 88 are in alignment with the holes 90 of cross member 92. Pad 88 is a vibration dampening member which is made of plastic. A bracket 78 is generally U-shaped having a tongue extending from a base portion of bracket 78. Bracket 78 has a pair of holes disposed therethrough. The holes of bracket 78 are aligned with the holes in pad 88 and the holes through cross member 92. Bracket 98 has a pair of arms 80 which extend upwardly at a 90° angle from the base of bracket 78. Each arm 80 has a hole 82 disposed therethrough. The holes 82 of each arm 80 are coaxial with one another. The arms 80 of bracket 78 straddle the spring 74. Bracket 78, and spring 74 are coupled to acme nut 70 by the insertion of mounting bolts 84. Mounting bolts 84 are placed through holes 82 of mounting bracket 78, holes 76 of spring 74 and are threadingly engaged into the holes 72 of acme nut 70. A washer 68 is placed between the head of bolt 84 and the hole 82 of bracket 78. Bracket 78 and pad 88 are secured to cross member 92 by the use of bolts which extend through the holes of bracket 78, pad 82 and threadingly engage the anchors secured within holes 90 of cross member 92. This assembly acts as a pivot between the shaft 68 and base portion 14.

In operation, motor 62 rotates shaft 68 through transmission 66. In turn, acme nut 70 may travel either towards or away from transmission 66. As acme nut 70 approaches the terminal ends of shaft 68, limit switches (not shown) terminate the rotation of motor 62. Thus, acme nut 70 is prevented from turning off the free end of shaft 68 or stripping its internal threads by engagement with transmission 66. The limit switches are conventional and well-known in the art as is the circuitry associated with the limit switches which terminate the rotation of reversible motor 62. Furthermore, motor 62, transmission 66 and shaft 68 are pivotable about pin 56. The pivotable movement of motor 62, transmission 66 and shaft 68 is unimpeded by cross member 32 because of the recess 34. See FIG. 3. Thus allowing this assembly to compactly fit within chair 10.

Laterally adjacent the ends of recess 34 is a pair of screw holes. A roller bearing pad 94 having a pair of holes disposed therethrough is in face contact with the cross member 32. The holes through pad 94 are aligned with the holes in member 32. See FIG. 3. A roller bearing bracket 96 having a pair of holes through a base portion of the bracket 96 is in face contact with pad 94. The holes in bracket 96 are in alignment with the holes of pad 94. Bracket 96 has a pair of semicircular arms which extend from the base portion of bracket 96 at a 90° angle therefrom. Each arm 98 has a hole 100 disposed therethrough. The holes 100 are coaxial with one another. Screws 106 extend through the holes of the base portion of bracket 96, the holes of pad 94 and are engaged with cross member 32 at the holes therein. Screws 106 secure the roller bracket 96 and pad 94 to the cross member 32. A roller bearing 102 has a hole 104 coaxial therewith. Roller bearing 102 is inserted between arms 98 of bracket 96. The holes 100 of bracket arms 96 are coaxially aligned with hole 104 of roller bearing 102. A roller bearing pin 108 is inserted through hole 100, hole 104 and exits hole 100 of the bracket 96. Pin 108 is secured therethrough by a roller bearing cap 110. Furthermore, the roller bearings assemblies (brackets 96 and bearing 102) are low profile. Thus, a gap spacing between the seat portion 12 and base portion 14 is minimized so to prevent human body portions from being pinched therebetween.

Roller bearing 102 is in rolling engagement with a track means. Track means includes a track portion 112. Track portion 112 is in face contact with a vibration dampening pad 114. Pad 114 is located below track 112. A arcuate base side member 116 is located below pad 114. Track 112 and pad 114 are secured to side member 116. The base side member 116 can be the laterally disposed concave side members previously described or a separate member affixed to the laterally disposed concave side members. Pad 114 is made of a plastic material. There are at least four roller bearing and track assemblies located on the adjustable chair. Roller bearings 102 allow seat portion 12 to move in an arcuate path defined by the base portion 14.

The present invention may be embodied in other specific forms without departing from the spirit or essential attributes thereof and, accordingly, reference should be made to the appended claims, rather than to the foregoing specification, as indicating the scope of the invention.

I claim:

1. An adjustable chair comprising:

a seat portion having a convex undersurface, said seat portion including laterally disposed convex side members joined together by a plurality of cross members;

roller means fixed in a spaced apart relation along said convex side members;

a base portion having a concave upper surface, said base portion including laterally disposed concave side members joined together by a plurality of cross members and a plurality of legs affixed to said concave side member;

track means fixed in spaced apart relation along said concave side members; said roller means adapted for rolling engagement along said track means;

power transmission means, a first end of said power means pivotably connected to a cross member of said seat portion, a second end of said power means pivotably connected to a cross member of said base portion, said power means being adapted to move said seat portion along an arcuate path defined by said concave upper surface of said base portion; and a noise dampening preload means associated with said second end of said power means.

2. The adjustable chair according to claim 1 wherein said roller means comprises a vibration dampening pad in face contact with said convex side member, a low profile bracket in face contact with said vibration dampening pad and a low profile bearing secured for rolling movement in said bracket.

3. The adjustable chair according to claim 1 wherein said track means comprises a vibration dampening pad secured to said concave side member, and a track portion in face contact and secured to said vibration dampening pad.

4. The adjustable chair according to claim 1 wherein said power transmission means comprises:

a reversible motor;

a reversibly rotatable threaded shaft, said shaft being parallel to and spaced away from said motor;

a transmission, said transmission being coupled to said motor and shaft, said transmission being perpendicular to said motor and said shaft, and a translation means being movable along an axis of said shaft, said noise dampening preload means straddling said translation means.

5. The adjustable chair according to claim 4 wherein said translation means is an acme nut.

6. The adjustable chair according to claim 4 wherein said noise dampening preload means further comprises:

a base;

a pair of arms extending from the lateral sides of said base at a 90° angle; and a tongue integral with said base, a free end of said tongue being in contact with said translation means.

7. The adjustable chair according to claim 1 further comprising:

a seat portion motion limiting means, said motion limiting means being disposed at said first and second ends of said power transmission means, said motion limiting means being adapted to terminate movement of said seat portion along said arcuate path.

8. The adjustable chair according to claim 7 wherein said motion limiting means is a limit switch.

9. An adjustable chair comprising:

a seat portion having a convex undersurface, said seat portion including laterally disposed convex side members joined together by a plurality of cross members;

roller means fixed in a spaced apart relation along said convex side members wherein said roller means comprises a vibration dampening pad in face contact with said convex side member, a low profile bracket in face contact with said vibration dampening pad and a low profile bearing secured for rolling movement in said bracket;

a base portion having a concave upper surface, said base portion including laterally disposed concave side members joined together by a plurality of cross members and a plurality of legs affixed to said concave side member;

track means fixed in spaced apart relation along said concave side members; said roller means adapted for rolling engagement along said track means wherein said track means comprises a vibration dampening pad secured to said concave side member, and a track portion in face contact and secured to said vibration dampening pad;

power transmission means, a first end of said power means pivotably connected to a cross member of said seat portion, a second end of said power means pivotably connected to a cross member of said base portion, said power means being adapted to move said seat portion along an arcuate path defined by said concave upper surface of said base portion wherein said power transmission means comprises a reversible motor, a reversibly rotatable thread shaft, said shaft being parallel to and spaced away from said motor, a transmission, said transmission being coupled to said motor and shaft, said transmission being perpendicular to said motor and said shaft, and a translation means being movable along an axis of said shaft; and a noise dampening preload means associated with said second end of said power means said noise dampening preload means straddling said translation means.

10. The adjustable chair according to claim 9 wherein said translation means is an acme nut.

11. The adjustable chair according to claim 9 wherein said noise dampening preload means further comprises:

a base;

a pair of arms extending from the lateral sides of said base at a 90° angle; and a tongue integral with said base, a free end of said tongue in contact with said translation means.

12. The adjustable chair according to claim 9 further comprising:

a seat portion motion limiting means, said motion limiting means being disposed at said first and second ends of said power transmission means, said motion limiting means being adapted to terminate movement of said seat portion along said arcuate path.

13. The adjustable chair according to claim 12 wherein said motion limiting means is a limit switch.

* * * * *